United States Patent [19]

Erickson

[11] 4,279,571

[45] Jul. 21, 1981

[54] PITOT PUMP WITH FLUID LUBRICATED BEARINGS

[75] Inventor: John W. Erickson, Huntington Beach, Calif.

[73] Assignee: Kobe, Inc., Commerce, Calif.

[21] Appl. No.: 80,377

[22] Filed: Oct. 1, 1979

[51] Int. Cl.[3] ..... F04D 1/14

[52] U.S. Cl. ..... 415/89; 415/111

[58] Field of Search ..... 415/88, 89, 111; 308/DIG. 8

[56] References Cited

U.S. PATENT DOCUMENTS

| | | | |
|---|---|---|---|
| 2,253,969 | 8/1941 | Dawihl et al. | 308/DIG. 8 |
| 4,087,137 | 5/1978 | Voitas | 308/DIG. 8 |

FOREIGN PATENT DOCUMENTS

| | | | |
|---|---|---|---|
| 1368864 | 6/1964 | France | 415/89 |
| 975075 | 11/1964 | United Kingdom | 308/DIG. 8 |

OTHER PUBLICATIONS

"Interim Notes on Precision Ball Bearing Developments" Technical Memo from the Barden Corp., 12/15/60.

*Primary Examiner*—Louis J. Casaregola
*Attorney, Agent, or Firm*—William C. Norvell, Jr.

[57] ABSTRACT

A hollow casing defining a fluid chamber is rotated relative to a stationary pitot tube mounted within the casing. The pitot tube is supported by a stationary hollow discharge tube whose bore defines the fluid outlet passage for the pump. An annular fluid inlet passage is provided surrounding one end of the discharge tube. Cylindrical portions on the discharge tube provide hardened bearing surfaces for cooperation with hardened sleeve bearings carried by the axially opposed end walls of the rotating casing. Radial flanges on such hardened bearing members provide thrust bearing capability if required. The bearings are exposed to the fluid being pumped and lubricated by such fluid.

7 Claims, 1 Drawing Figure

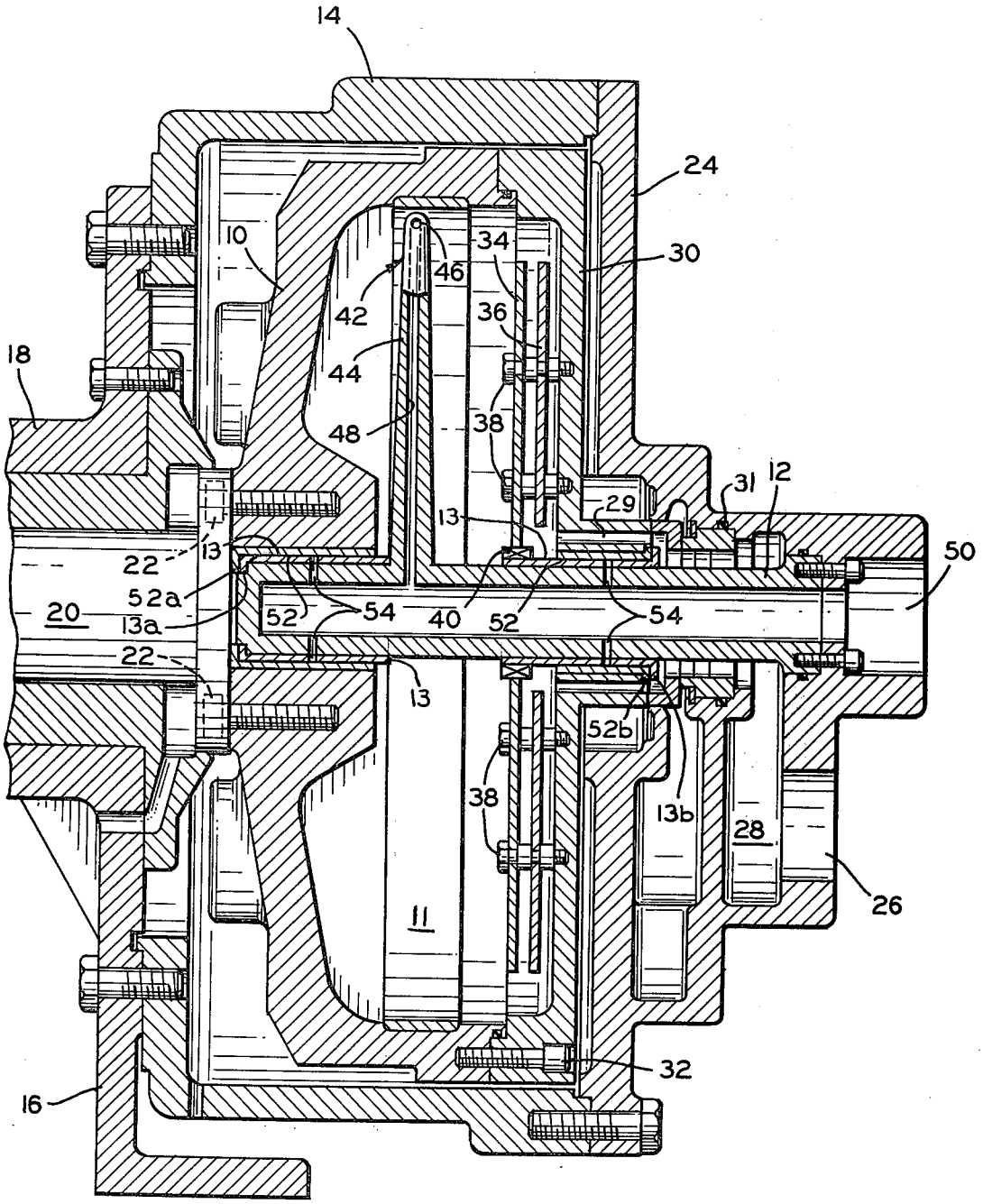
14
24
10
34
30
46
42
36
18
44
48
38
31
12
29
13
50
22
13
52a
20
13a
52
54
40
52
54
22
13
52b
38
13b
28
26
11
32
16

PITOT PUMP WITH FLUID LUBRICATED BEARINGS

BACKGROUND OF THE INVENTION

1. Field of the Invention

The invention relates generally to a centrifugal pumping apparatus of the type wherein a hollow casing is supplied with fluid to be pumped and the casing rotates about a stationary pitot tube having its opening opposed to the direction of rotation of the fluid in the rotating casing.

2. Description of the Prior Art

U.S. Pat. No. 3,838,939 discloses the basic structural details and operation characteristics of a typical pitot centrifugal pump. The pump includes a rotating casing and a stationary pitot or pick-up tube within the casing. The fluid to be pumped enters an intake manifold and passes into a rotating casing wherein the fluid is accelerated to the rotational velocity of the casing. A pitot tube has an opening facing the direction of rotation of the rotating fluid and hence a jet-like stream of fluid is forced into the pitot tube and flows from the pitot tube to an outlet through an axial passage defined by a hollow shaft on which the pitot tube is mounted. Fairly complex and expensive bearings are provided for mounting the casing for rotation relative to the pick-up tube and, at a still further manufacturing cost penalty, complicated sealing arrangements are provided to prevent any of the fluid being pumped from contacting the bearings, and a separate lubrication system is required. This relatively complicated and costly design is believed to be necessary because the bearing materials heretofore employed were relatively soft and hence subject to rapid abrasive wear if the fluid being pumped contained any significant amounts of particulates. In oil field pumping applications, it is well known that substantially all of the fluid required to be pumped contains significant amounts of sand, and therefore a significant manufacturing cost penalty was incurred to provide elaborate sealing and lubricating arrangements for insuring that the bearings would not be contacted by the particulate-containing fluid being pumped.

SUMMARY OF THE INVENTION

This invention recognizes that bearing materials are available having a significantly higher degree of hardness than that of the particulates contained in fluids to be pumped in oil field applications. Therefore, instead of incurring the expense of isolating the pitot pump bearings from the fluid to be pumped, whether journal type or thrust bearings, this invention provides a pump configuration wherein the bearings are completely exposed to the fluid to be pumped and lubricated by such fluid. The hardness of the bearings insures that their service life will be adequate for the particular application, and, in fact, equal to or in excess of the service life of prior art bearings provided with separate sealing and lubricating arrangements to protect the bearings from contact with the fluid being pumped.

Spaced cylindrical surfaces are provided on the stationary support tube for the pitot tube as one element of a journal-type bearing together with cooperating sleeve elements mounted in the two end walls of the rotating casing defining the rotating fluid chamber. The cylindrical surfaces and the sleeve elements have a hardness higher than sand. If thrust resistance is required, such may be provided by cooperating radial flanges formed on the ends of the cylindrical surfaces and the sleeve elements. The ends of such cooperating bearing elements are completely exposed to the fluid being pumped and hence such fluid may be relied upon for lubricating the sleeve bearings. Additionally, a portion of the pressured fluid leaving the pump may be diverted to flow directly between the cooperating bearing surfaces.

Accordingly, it is an object of the present invention to provide an improved pitot pump which may be manufactured for substantially less cost than prior art pumps and provide adequate performance and service life.

A particular object of the present invention is to provide simple and economical journal and thrust bearings for supporting the rotating casing of a pitot pump for rotation relative to stationary fluid pick-up tube.

Other objects and advantages will become apparent to those skilled in the art from the following detailed description of a preferred embodiment of the invention, taken in conjunction with the accompanying drawing.

BRIEF DESCRIPTION OF THE DRAWING

The single FIGURE in the drawing represents an elevational cross-section of a pitot pump constructed in accordance with this invention.

DESCRIPTION OF THE PREFERRED EMBODIMENTS

Referring to the drawing, there is illustrated a pitot pump having a casing 10 mounted to rotate relative to a fixed hollow discharge tube 12. The casing 10 is rotatably mounted within an outer housing 14, which is typically secured to a supportive base or pedestal 16. The pedestal 16 includes a generally horizontally extending cylindrical hollow sleeve 18. A drive shaft 20 is disposed coaxially within the hollow sleeve 18, the innermost end of which is typically secured to the end wall **10*a* of the rotatable casing 10 by means of a plurality of threaded fasteners 22. The opposite end of the housing 14 from that which receives the drive shaft 20 is provided with a face plate 24 having an outwardly extending fluid inlet 26 and an associated inlet chamber 28**.

The inlet chamber 28 communicates with a plurality of inlets 29 to the interior of the casing 10, which are typically formed in the inner portions of an end plate 30 secured to the peripheral edges of the casing 10 by peripherally spaced threaded fasteners 32. The casing 10 and plate 30 thus define a rotating fluid chamber. A pair of spaced apart annular flat plates 34 and 36 are secured in parallel spaced relation to the inner surface of the end plate 30 by appropriately disposed threaded spacer elements 38. The plates 34 and 36 are positioned in coaxial relation about the shaft 12. A rotary seal element 40 is disposed between the outer surface of the internal shaft 12 and the inner annular edge of the annular flat plate 34 to insure that the incoming fluid moves radially outwardly to enter the chamber 11.

Within the internal chamber 11 of the rotatable casing 10, there is disposed a pitot tube or pick-up element 42 which includes a radially extending arm portion 44 and a generally circumferentially extending head portion 46 on the outer end of the arm 44. The pickup element 42 is integral with, or stationarily mounted with respect to, the discharge tube 12 and has an internal passageway 48 in communication with the interior of the hollow tube 12. The pickup head 46 has a preferably circular intake opening 47 at its leading end which extends forwardly of the leading edge of the arm portion 44 for optimum efficiency and opposes the rotating fluid. The intake opening 47 is in fluid communication with the internal passageway 48.

The casing 10 is mounted for rotation upon bearing means located within the casing. In the illustrated embodiment, a pair of axially spaced sleeve bearings 52 are disposed within the rotatable casing 10 for rotatably mounting the casing 10 upon bearing support means defined as the hollow discharge tube 12.

A cylindrical bearing surface 13 is provided on each side of the juncture of the pick-up arm 42 with the discharge tube 12. Such bearing surface may be formed by shrinking a sleeve of appropriate material on each end of the tube 12, or the required hardness for the bearing surface may be accomplished by a specialized treatment of the surface of the tube 12. In any event, the cylindrical bearing surface portions 13 are formed to have a hardness in excess of that of sand in order to assure that contact of such bearing surfaces with sand or other particulate in the fluid being pumped will not significantly affect the wear life of the bearing surface.

Similarly, the cooperating sleeve bearings 52 are formed of a material, or are treated so as to provide interior cylindrical bearing surfaces which have a hardness in excess of that of sand.

Those skilled in the art will recognize that a number of materials are available from which the bearing surfaces of the sleeves 52 and the cylindrical bearing surfaces 13 may be fabricated. Tungsten carbide constitutes one of such materials and a material known in the trade as "STELLITE" also has suitable bearing and hardness properties.

It will be noted that at least one end of each of the bearing sleeves 52 and the cooperating bearing surfaces 13 are exposed to the fluid in chamber 11, hence such fluid will function as a lubricant for the cooperating bearing surfaces, thus eliminating the need for a separate lubricating system for the bearings of the pump.

To further insure the adequate lubrication of the cooperating bearing surface, a plurality of generally radially directed lubricating apertures 54 may be formed in the hollow tube 12 and extended through the cylindrical bearing surfaces 13. Such apertures divert a portion of the pressurized fluid passing through the hollow bore of the discharge tube 12 into the bearings. Fluid discharged from the bearings re-enters the pumping chamber 11.

In the event that significant thrust forces are produced in the pump operation, the bearing sleeves 13 may be provided with hardened radial flanges 13*a* and 13*b* which respectively cooperate with hardened radial flanges 52*a* and 52*b* provided on sleeves 52. Such thrust bearing surfaces are also exposed to the contaminant fluid and lubricated thereby.

It will further be noted that only a minimum of seals are employed in the described pump construction. For example, a simple O-ring seal 31 is provided between the axial end portion of the end plate 30 and the stationary face plate 24 to prevent leakage of incoming fluid at that point. Because all the cooperating bearing surfaces are formed of materials sufficiently hard to resist the abrasive action of sand, it is not necessary to provide seals to isolate such bearing surfaces from all contact with the fluid being pumped.

In operation, the drive shaft 20 is typically connected to a rotary drive means (not shown), such as an electric motor. The motor imparts rotation to the casing 10 at speeds which may exceed 3,000 r.p.m. As the casing 10 is rotated, contaminant fluid is drawn from a source (not shown) through the inlet 26 into the inlet chamber 28 of the face plate 24, through inlet 29 and further into the radial passageways defined by the spaced apart plates 34 and 36 and the inner wall of the end plate 30. The centrifugal force caused by the rotation of the chamber 11 causes the fluid to enter the interior of the chamber 10 with a high rotational velocity. The heavier particulates contained in the fluid are forced to the outer extremities of the inner peripheral surface of the casing 10. The inlet opening 47 of the head portion 46 of the pickup element 42 will "inhale" whatever particulate material or fluid is present in the zone at which the inlet opening is disposed and convert the rotational velocity of such fluid to a pressure head.

The fluid within the casing 10 can seep from the casing 10 to the sleeve bearings 52, and provide a lubricating effect between the casing 10 and the hollow tube 12 on which the casing 10 rotates. In addition, fluid which enters the inlet opening of the head portion 46 of the pickup element 42 flows through the internal passageway 48 to the outlet pipe 50, wherein some fluid is provided to the sleeve bearings 52 through the lubricant apertures 54 formed in the hollow tube 12. The remainder of the pressured fluid leaves the casing through the hollow discharge tube 12.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a centrifugal pump having a hollow casing defining a concentric fluid chamber, means for rotating said casing about the axis of said chamber, a stationary hollow discharge tube projecting within said casing in coaxial relationship to said axis of rotation, conduit means for supplying fluid to be pumped to said fluid chamber, whereby the fluid is rotated by said casing, a radially projecting, hollow arm secured to said hollow discharge tube within said chamber, an opening in the end of said hollow arm disposed in facing relation to the rotating fluid, thereby inducing a high velocity fluid flow into said hollow arm and into the bore of said hollow discharge tube, the improvement comprising:

at least one bearing surface secured to the central portion of said casing, said surface being formed of material having a hardness greater than sand;

a second bearing surface on said stationary hollow discharge tube cooperating with said one bearing surface in bearing relationship, said second bearing surface having a hardness greater than sand; and means for directing a portion of the fluid flow from said bore of said hollow discharge tube to said bearing surfaces, whereby such fluid lubricates said bearing surfaces.

2. In a centrifugal pump having a hollow casing defining a concentric fluid chamber, means for rotating said casing about the axis of said chamber, a stationary hollow discharge tube projecting within said casing in coaxial relationship to said axis of rotation, conduit means for supplying fluid to be pumped to said fluid chamber, whereby the fluid is rotated by said casing, a radially projecting, hollow arm secured to said hollow discharge tube within said chamber, an opening in the end of said hollow arm disposed in facing relation to the rotating fluid, thereby inducing a high velocity fluid flow into said hollow arm and into the bore of said hollow discharge tube, the improvement comprising:

at least one bearing sleeve concentrically secured to the central portion of said casing, said sleeve being formed of material having a hardness greater than sand;

a cylindrical surface portion on said stationary hollow discharge tube cooperating with said sleeve in bearing relationship, said cylindrical portion having a hardness greater than sand;

means for directing a portion of the fluid flow from said bore of said hollow discharge tube to said bearing surfaces and at least one axial end of said bearing sleeve being exposed to the fluid in said chamber, whereby such fluid lubricates the bearing surfaces of said sleeve and said cylindrical surface portion.

3. The improvement defined in claim 2 plus integral radial surfaces respectively secured to said bearing sleeve and said cylindrical surface portion cooperating to resist axial thrust forces.

4. In a centrifugal pump having a hollow casing defining a concentric fluid chamber, means for rotating said casing about the axis of said chamber, a stationary hollow discharge tube projecting within said casing in coaxial relationship to said axis of rotation, conduit means for supplying fluid to be pumped to said fluid chamber, whereby the fluid is rotated by said casing, a radially projecting, hollow arm secured to said hollow discharge tube within said chamber, an opening in the end of said hollow arm disposed in facing relation to the rotating fluid, thereby inducing a high velocity fluid flow into said hollow arm and into the bore of said hollow discharge tube, the improvement comprising:

at least one bearing sleeve concentrically secured to the central portion of said casing, said sleeve being formed of material having a hardness greater than sand;

a cylindrical surface portion on said stationary hollow discharge tube cooperating with said sleeve in bearing relationship, said cylindrical portion having a hardness greater than sand; and said hollow discharge tube having a radial passage from said cylindrical surface portion to the bore of said tube, whereby pressured output fluid in the bore of said tube lubricates the bearing surfaces of said sleeve and said cylindrical surface portion.

5. In a centrifugal pump having a hollow casing defining a concentric fluid chamber, means for rotating said casing about the axis of said chamber, a stationary hollow discharge tube projecting within said casing in coaxial relationship to said axis of rotation, conduit means for supplying fluid to be pumped to said fluid chamber, whereby the fluid is rotated by said casing, a radially projecting, hollow arm secured to said hollow discharge tube within said chamber, an opening in the end of said hollow arm disposed in facing relation to the rotating fluid, thereby inducing a high velocity fluid flow into said hollow arm and into the bore of said hollow discharge tube, the improvement comprising:

a pair of bearing sleeves respectively secured to central portions of said casing in axially spaced relationship, said sleeves being respectively disposed on opposite sides of said hollow radial arm, said sleeves being formed of material having a hardness greater than sand;

a pair of axially spaced cylindrical surface portions on said hollow tube respectively cooperating with said sleeves in bearing relationship, said cylindrical surface portions each having a hardness greater than that of sand; and at least one axial end of each said bearing sleeve being exposed to the fluid in said chamber, whereby such fluid lubricates the bearing surfaces of each said sleeve and each said cylindrical surface portion.

6. The improvement defined in claim 5 further comprising integral surfaces respectively secured to one of said bearing sleeves and one of said cylindrical surface portions cooperating to resist axial thrust forces.

7. In a centrifugal pump having a hollow casing defining a concentric fluid chamber, means for rotating said casing about the axis of said chamber, a stationary hollow discharge tube projecting within said casing in coaxial relationship to said axis of rotation, conduit means for supplying fluid to be pumped to said fluid chamber, whereby the fluid is rotated by said casing, a radially projecting, hollow arm secured to said hollow discharge tube within said chamber, an opening in the end of said hollow arm disposed in facing relation to the rotating fluid, thereby inducing a high velocity fluid flow into said hollow arm and into the bore of said hollow discharge tube, the improvement comprising:

a pair of bearing sleeves respectively secured to central portions of said casing in axially spaced relationship, said sleeves being respectively disposed on opposite sides of said hollow radial arm, said sleeves being formed of material having a hardness greater than sand;

a pair of axially spaced cylindrical surface portions on said hollow tube respectively cooperating with said sleeves in bearing relationship, said cylindrical surface portions each having a hardness greater than that of sand; and fluid conduit means respectively connecting the bore of said hollow discharge tube with each said cylindrical surface portion, whereby the pressured fluid in said hollow discharge tube lubricates the bearing surfaces of said sleeves and said cylindrical surface portions.

* * * * *